US005991920A

United States Patent [19]

Holland

[11] Patent Number: 5,991,920

[45] Date of Patent: Nov. 30, 1999

[54] COLLAPSIBLE SWIMSUIT

[75] Inventor: David C. Holland, Houston, Tex.

[73] Assignee: New Universe Designs, Inc., Houston, Tex.

[21] Appl. No.: 09/094,242

[22] Filed: Jun. 9, 1998

[51] Int. Cl.[6] ..... A41D 5/00; A41D 27/20; A41B 9/00

[52] U.S. Cl. ..... 2/67; 2/400; 2/247

[58] Field of Search ..... 2/67, 78.1, 109, 2/400, 406, 94, 247

[56] References Cited

U.S. PATENT DOCUMENTS

| | | |
|---|---|---|
| 2,018,782 | 10/1935 | Gephart . |
| 2,085,425 | 6/1937 | Goodwin . |
| 2,206,412 | 7/1940 | Levy . |
| 2,272,830 | 2/1942 | Brody et al. . |
| 2,335,658 | 11/1943 | Fishbein . |
| 2,355,404 | 8/1944 | Virden et al. . |
| 2,401,457 | 6/1946 | Bryant . |
| 2,419,867 | 4/1947 | Woodman . |
| 2,622,600 | 12/1952 | De Guyot et al. . |
| 3,306,299 | 2/1967 | Paramore . |
| 3,774,241 | 11/1973 | Zerkle . |
| 3,847,158 | 11/1974 | Guidoni . |
| 3,939,845 | 2/1976 | Guidoni . |
| 4,031,900 | 6/1977 | Guidoni . |
| 4,121,305 | 10/1978 | Kolker . |
| 4,404,689 | 9/1983 | Dewan . |
| 4,674,135 | 6/1987 | Greene . |
| 5,459,875 | 10/1995 | Fattorusso et al. . |
| 5,483,701 | 1/1996 | Ferreyros . |
| 5,551,093 | 9/1996 | Stricker . |
| 5,584,077 | 12/1996 | Thrift . |
| 5,664,257 | 9/1997 | Hall . |

*Primary Examiner*—John J. Calvert
*Assistant Examiner*—Shirra L. Jenkins

[57] ABSTRACT

A swimsuit includes a body and a belt, a portion of the body encircling a portion of the belt to form at least one pouch. The other end of the body has fastening devices that attach them to the belt opposite the pouch to form a conventional-looking swimsuit. Detaching the clips, folding up the body and inserting it into the pouch(es) gives a compact arrangement of a belt with a small pouch attached to it. For use by females, an upper body cover has a belt for encircling the body and two patches for covering the breasts. Each patch is provided with its own storage compartment into which it can be stowed after being folded.

15 Claims, 3 Drawing Sheets

COLLAPSIBLE SWIMSUIT

FIELD OF THE INVENTION

This invention relates to a collapsible garment and a method for using the same. More particularly, the invention relates to a swimsuit that can be folded into its belt or a pouch attached to the belt without the necessity of taking the garment off.

BACKGROUND OF THE INVENTION

In recent years, there has been an increased interest in the "back to nature" movement and in enjoying life unencumbered by clothes. Most jurisdictions have regulations against public nudity and this acts as a restraint on those who would like to enjoy life in pretty much the state in which they were born. People will be people and those who would like to swim "in the raw", so to speak, have two choices if they wish to act unfettered: (a) wear no clothing, or, (b) wear a swimsuit on the beach and take it all off when at a safe distance from any Peeping Toms.

As noted above, option (a) is usually illegal and, in many instances, aesthetically unappealing. There are few things as disgusting as seeing it all hang out when the viewer is better off with it concealed. There is also the problem of finding a deserted location at which to take off the swimsuit. Facilities for discrete donning and removal of clothing may not exist at beaches and swimming pools. Removing clothing also presents problems in cold and/or windy weather.

Option (b), while aesthetically more appealing to the public at large, presents dangers to the swimmer. Taking the swimsuit off under water requires either bending down or stepping out of the swimsuit and can be dangerous and has the problem of collecting sand and grit inside the swimsuit. There is the additional problem of holding on to the garment once it has been taken off: if both hands are not devoted to the task, there is the risk of losing the swimsuit and the swimmer is back to the situation presented in option (a). Prior art swimsuits also present problems in putting the swimsuit back on. There is difficulty in identifying the proper holes into which legs must go, particularly in active surf. Once back on, any accumulated sand and grit can be very uncomfortable.

There is a need for a swimsuit that enables the law abiding swimmer to comply with applicable rules and regulations. Such a swimsuit should allow the swimmer to enter the water discretely clothed. Such a swimsuit should preferably be safe and easy to disengage from the human body. Such a swimsuit should remain attached to the human body without the use of hands. Such a swimsuit should be easy to put back on. In addition, it should preferably be aesthetically appealing in both the engaged and disengaged positions. The present invention satisfies this need.

SUMMARY OF THE INVENTION

The present invention is a swimsuit having a belt and detachable fasteners that attach the main body of the swimsuit to the belt. The main body can be attached to either the front or to the back of the belt. In one embodiment, the back of the main body loosely encloses the belt, forming at least one storage compartment. The fasteners are then on the front of the main body. In the closed position, the fasteners are engaged, presenting the appearance of a conventional swimsuit. To stow the swimsuit, the fasteners are disengaged, the body is compacted by rolling and/or folding it, and the compacted body is inserted into the opening in the at least one storage compartment. Reacquiring modesty requires releasing the compacted body from the storage compartment (s), uncompacting the body, and reattaching it to the front portion of the belt. Even in the stowed position, the swimsuit presents a smooth silhouette.

DETAILED DESCRIPTION OF THE INVENTION

Figure 1:
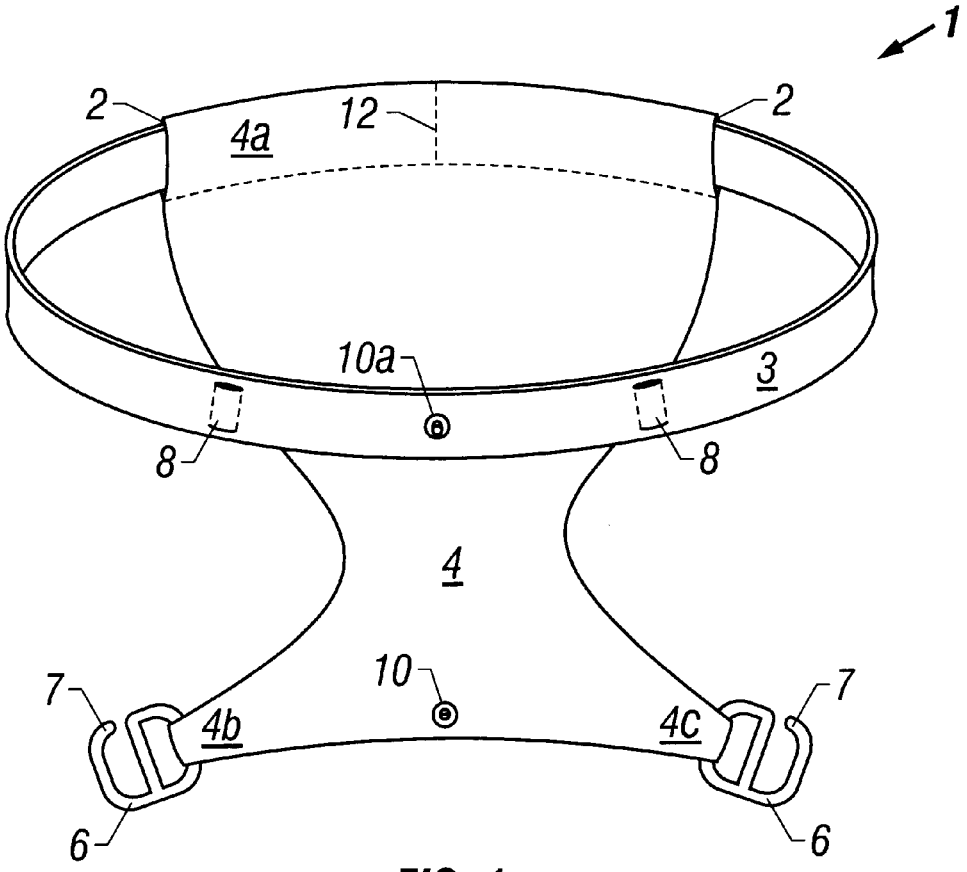
FIG. 1 is a view of a garment according to the present invention.
Figure 2:
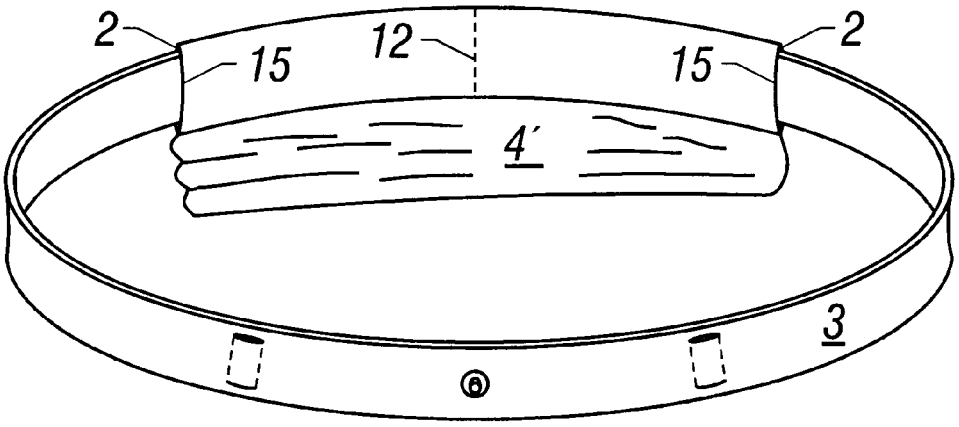
FIG. 2 shows the garment of FIG. 1 with the body rolled or folded up.

The present invention is best understood with reference to FIGS. 1–2 that illustrate the arrangement of the various parts of the swimsuit. Referring to FIG. 1, a swimsuit 1 is shown. The swimsuit includes a belt 3 adapted to encircle a human waist. For purposes of describing the invention further, the belt defines an inside and an outside. The belt is preferably made of a fabric with some ability to stretch so as to maintain a snug fit with the waist of the person wearing the garment. The swimsuit also includes a body part 4, one end 4*a* of which defines a pair of pouches (storage compartments) 2 that enclose a portion of the belt. The sides of pouches are maintained in sliding contact with the portion of the belt that they encircle and are provided with openings purpose of which will be discussed below. In one embodiment of the invention, as shown in FIG. 1, there are a pair of pouches separated by a seam 12 in the middle, the seam coupling the body part 4 to the belt 3. In an alternate arrangement, not shown, the seam 12 is at one end of the body and only one pouch 2 is provided with an opening at the end opposite the seam 12.

Still referring to FIG. 1, the side of the body 4 away from the end 4*a*, designated here by 11, is provided with a pair of fastening devices 6. In the illustration shown, the fastening devices are clips 6 that are coupled to ends 4*b* and 4*c* of the side 11 by having a portion of the clip enclosed by 4*b* and 4*c* and sewn on to them. The free ends of the clips, designated by 7, are adapted to engage with loops 8 on the inside of the belt 3.

Figure 1A:
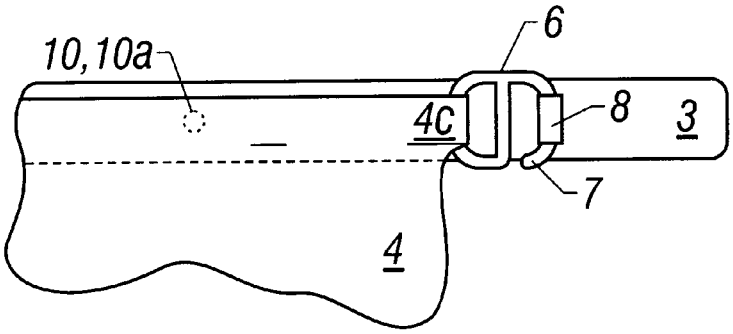
FIG. 1A shows a detail of the manner of attachment of the body to the belt.

FIG. 1A shows details of the manner in which the body is attached to the belt by the fastening devices. The view shown in FIG. 1A corresponds to looking out from the interior of the space defined by the belt in FIG. 1. Shown is a portion of the body 4, the end 4*c* enclosing a portion of the clip 6, and the end 7 of the clip engaged inside the loop 8 on the belt 3. The loop 8 is preferably made of a fabric.

Also shown in FIGS. 1, 1A are a plurality of supplementary fastening devices, of which one pair 10 and 10*a* are shown. However, the preferred embodiment also employs press buttons with one portion on the inside of the belt and the other portion on the body. The press buttons serve to locate the panel correctly for purposes of appearance and to provide additional security. Those versed in the art would recognize that press buttons could also be used as the primary fastening device.

Figure 2A:
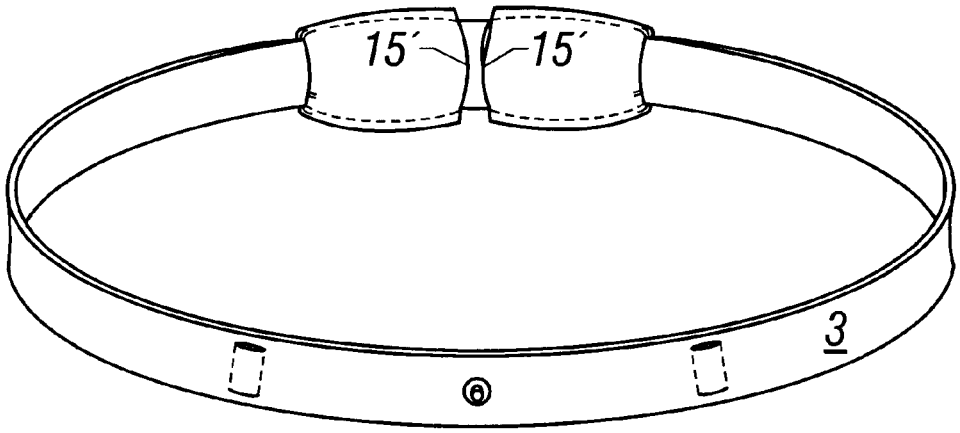
FIG. 2A shows the garment of FIG. 1 with the body stowed into the storage compartment in the body.

FIG. 2 illustrates the invention when the clips are disengaged and the body is rolled up tightly to abut the pouches 2 encircling the belt. The body in the rolled up position is depicted by 4'. Also shown are the openings 15 in the pouches 2. Because the pouches are made of the same material as the body and are flexible, the rolled up body can be inserted into the openings and at the same time, the edges of the opening 15 folded back to the position 15' shown in FIG. 2A. As shown in FIG. 2A, the ends of the opening have been folded back from both sides: in an alternate embodiment with only one pouch, the end is folded back from only one side and accomplishes the same function. As can be seen in FIG. 2*a*, when the clips are disengaged, the body rolled up, and the ends of the opening folded back, the entire garment collapses to a compact shape defined by the belt and the small enclosure around it.

These figures also illustrate the method of using the invention. When the body is engaged to the belt by the clips 6 and loop 8, the garment looks like a conventional swimsuit and can be worn as such on the beach. Upon entering the water, the wearer disengages the clips, rolls the body up and inserts it into the pouches around the belt. Some rotation of the belt may be necessary but the entire operation can be carried out safely and unobtrusively: no bending and no stepping out of the belt are necessary. This process can be carried out whether there are two pouches, as shown, or only one pouch with an opening at one end or along the side. The entire garment is safely attached to the body of the wearer, both of whose hands are free to perform activities like swimming without fear of losing the garment.

Figure 3:
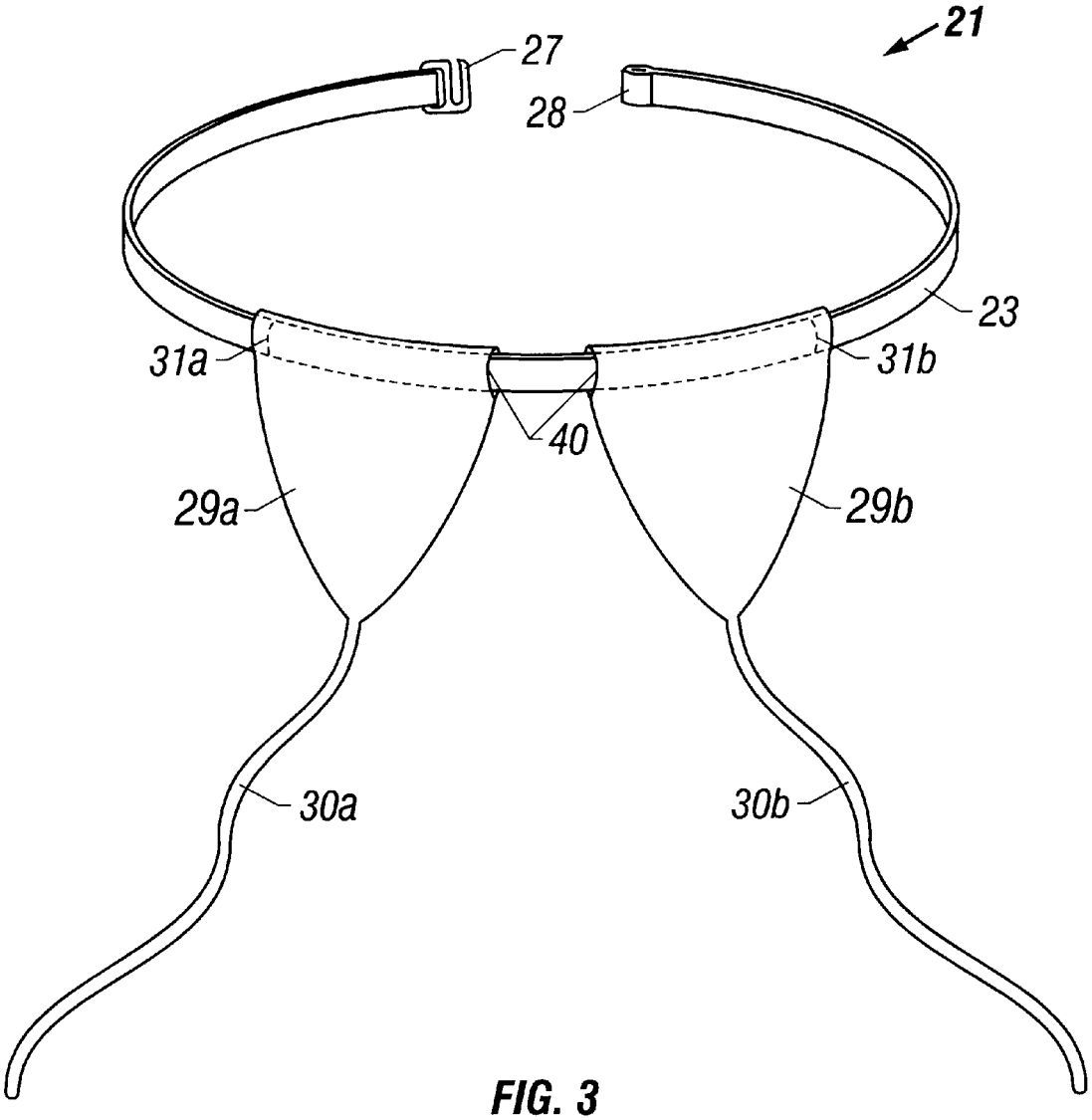
FIG. 3 shows an alternative embodiment of the invention.

FIG. 3 shows another aspect of the invention that is suitable for use by females. Shown is an upper garment 21 which has a belt 23 is adapted to be clipped around the upper part of the torso by means of clip 27 and a suitable hook 28 on the belt 23. A pair of generally triangularly shaped covers 29*a*, 29*b* are located on the belt 23 so as to be able to cover the breasts of the human wearing the garment. The covers 29*a*, 29*b* are attached to the belt 23 by stitches denoted by 31*a*, 31*b*. The stitches 31*a*, 31*b* also serve to define pouches, the ends of which are denoted by 40 between the triangular covers and the belt 23. Strips 30*a*, 30*b* on the apices of the covers 29*a*, 29*b* may be tied around the wearer's neck ( or to the belt in the rear)to provide additional support for the front of the upper garment. The upper garment is designed to be used in the same manner as the garment discussed above with reference to FIGS. 1–2. The garment may be worn as the upper part of a prior art bikini with the straps 30*a*, 30*b* tied around the neck. To stow the garment, the straps 30*a*, 30*b* are untied. Each strap and the associated cover 29*a*, 29*b* are rolled up until they are compact and next to the belt 23. The ends 40 of the pouches are rolled over the cover to form a compact cache. The belt may be left in position or may be slid down to the lower part of the torso.

The construction of the device herein is not dependent upon any specific material and may be such that in certain versions, a combination of materials may be used. The device may have certain decorative design and color treatments intended to an esthetically pleasing appearance to the device.

The foregoing description has been limited to specific embodiments of this invention. It will be apparent, however, that variations and modifications may be made to the disclosed embodiments, with the attainment of some or all of the advantages of the invention. Therefore, it is the object of the appended claims to cover all such variations and modifications as come within the true spirit and scope of the invention

What is claimed is:

1. A garment comprising:

(a) a first member adapted to encircle a human torso;

(b) a second member having a body, first end and a second end, the body being between the first end and the second end, the first end encircling and slidably coupled to a first portion of the first member defining at least one storage compartment therebetween, said second end adapted to be detachably coupled to a second portion of the first member; and (c) a plurality of fastening devices for coupling the second end of the second member to the second portion of the first member.

2. The garment of claim 1 wherein the first member is a belt.

3. The garment of claim 2 wherein the belt is made of a fabric.

4. The garment of claim 1 wherein the second member is made of a fabric.

5. The garment of claim 4 wherein the at least one storage compartment comprises two storage compartments.

6. The garment of claim 1 wherein the body of the second member is further adapted to be compacted and stowed using the at least one storage compartment.

7. The garment of claim 1 wherein the fastening device comprises a clip on the second member and a loop on the first member.

8. The garment of claim 1 wherein the fastening device comprises a pair of press buttons on the first and second members.

9. The garment of claim 1 further comprising a supplementary fastening device for detachably coupling the first and second members.

10. A method of removing a swimsuit while leaving it attached to a human body, comprising:

(a) decoupling a body of the swimsuit from a belt attached to the body;

(b) compacting the body into a small space; and (c) storing the compacted body using at least one storage compartment on the body, said at least one storage compartment encircling the belt.

11. The method of claim 10 wherein the storing of the compacted body using the at least one storage compartment is performed through one opening at an end of the at least one storage compartment.

12. The method of claim 10 wherein the at least one storage compartment comprises two storage compartments.

13. A garment comprising:

(a) a first member adapted to encircle a human torso; and (b) a pair of covers each having a body, first end and a second end, the body being between the first end and the second end, the first end encircling and slidably coupled to a first portion of the first member defining at least one storage compartment therebetween, said second ends adapted to be coupled to (i) a second portion of the first member or (ii) each other.

14. The garment of claim 13 wherein the first member is a belt.

15. A garment comprising:

(a) a first member adapted to encircle a human torso; and (b) a pair of covers each having a body, first end and a second end, each body having a first end and a second end, each first end encircling and slidably coupled to a first portion of the first member defining at least one storage compartment therebetween, said seconds ends adapted to be coupled to one of (i) a second portion of the first member and (ii) each other.

* * * * *